United States Patent [19]

McGaffigan et al.

[11] Patent Number: 4,522,457

[45] Date of Patent: Jun. 11, 1985

[54] COMPLIANT CONNECTING DEVICE WITH HEAT-RECOVERABLE DRIVER

[75] Inventors: Thomas H. McGaffigan, Redwood City; Harold B. Kent, San Carlos, both of Calif.

[73] Assignee: Raychem Corporation, Menlo Park, Calif.

[21] Appl. No.: 539,870

[22] Filed: Oct. 7, 1983

[51] Int. Cl.[3] ..... H01R 13/20

[52] U.S. Cl. ..... 339/30; 29/447; 339/259 R

[58] Field of Search ..... 339/30, 259 R, 259 F, 339/DIG. 1; 29/447

[56] References Cited

U.S. PATENT DOCUMENTS

| | | | |
|---|---|---|---|
| Re. 29,904 | 2/1979 | Fischer et al. | 361/413 |
| 3,012,882 | 1/1960 | Muldawer et al. | 75/134 |
| 3,174,851 | 3/1965 | Buehler et al. | 75/170 |
| 3,740,839 | 6/1973 | Otte et al. | 339/30 |
| 4,022,519 | 5/1977 | Hill | 339/DIG. 1 |
| 4,035,007 | 7/1977 | Harrison et al. | 285/381 |
| 4,198,081 | 4/1980 | Harrison et al. | 285/381 |

FOREIGN PATENT DOCUMENTS 703649 6/1971 Belgium .

*Primary Examiner*—Neil Abrams
*Attorney, Agent, or Firm*—James W. Peterson

[57] ABSTRACT

A reusable connecting device is disclosed which utilizes a heat-recoverable metallic driver connected to a socket having a biasing portion and a sequentially-operating overload portion. When it is desired to make a connection between this device and other objects, the object is placed within the socket and the driver is caused to shrink, thereby overcoming the biasing portion of the socket and causing the socket to contact and hold the object, the overload portion then acting as an overload mechanism for the heat-recoverable metallic driver.

9 Claims, 10 Drawing Figures

COMPLIANT CONNECTING DEVICE WITH HEAT-RECOVERABLE DRIVER

BACKGROUND OF THE INVENTION

1. Field of the Invention

This invention pertains to connectors which are capable of forming mechanical and/or electrical connection between two or more objects.

2. Description of the Prior Art

Commonly-assigned U.S. Pat. No. 3,740,839 and the reissue thereof, U.S. Pat. No. Re. 29,904, which are incorporated herein by reference, disclose a reusable connecting device having a forked resilient member having two tines or spring elements which are capable of being moved inwardly and when so moved exert an outward force on the means which is moving them inwardly and further including a band of heat-recoverable metallic material which is placed around the exterior of the tines of the fork member. The metallic band is caused to shrink, thereby urging the two tines toward one another and against an object inserted between them.

The usable size of the opening between the tines of the prior-art device is dependent primarily upon the elastic range of the heat-recoverable metallic material used in the band or driver. In general, this elastic range is small and therefore the range of pin size is limited. The instant invention simulates an extended elastic range of the band or driver by the use of an additional spring element, i.e., the socket overload portion which acts as an overload mechanism for the band or driver of heat-recoverable metallic material.

Heat-recoverable metals are disclosed in U.S. Pat. Nos. 3,012,882 to Muldawer et al and 3,174,851 to Buehler et al, and Belgian Pat. No. 703,649 to Wang et al, the disclosures of which are incorporated herein by reference. As made clear in these patents, these metal alloys undergo a transition between an austenitic state and a martensitic state at certain temperatures. When they are deformed up to ten percent while they are in the martensitic state, they will retain this deformation while held in this state but will revert to their original configuration when they are heated to a temperature at which they transfer to their austenitic state. This ability to shrink upon warming has been utilized in commonly-assigned U.S. Pat. Nos. 4,035,007 and 4,198,081, which are also incorporated by reference herein. The temperatures at which these transitions occur are affected, of course, by the nature of the alloy. The heat-recoverable metallic material, also known as a shape-memory alloy, from which the band may be fabricated is titanium-nickel-copper alloy, disclosed in the co-pending and commonly-assigned U.S. patent application Ser. No. 355,274, filed Mar. 5, 1982, which is incorporated herein by reference. Patent application Ser. No. 355,274 was abandoned in favor of continuation-in-part application Ser. No. 537,316, filed Sept. 28, 1983.

SUMMARY OF THE INVENTION

The purpose of this invention is to provide a reusable connecting device which is capable of forming a strong mechanical and/or electrical connection between the device and another member. To accomplish this purpose, the instant invention provides a connecting device having a driver of heat-recoverable metallic material which is connected to a socket comprising a biasing portion and an overload portion. The biasing portion is capable of being moved inwardly and when so moved exerts an outward force on the means which moves it inwardly. This function by itself causes the socket to open and close in conjunction with the reversible martensitic/austenitic transformation of the driver material. The sequentially-operating overload portion is also capable of being moved inwardly after the biasing portion is moved inwardly and thereby provides a large range of dimensional compliance and acts as an overload mechanism for the driver.

It is an object of the present invention to provide a device which will accept an insertable object such as a pin having a large dimensional range and over this range provide a high contact force.

DESCRIPTION OF THE PREFERRED EMBODIMENTS

Figure 1:
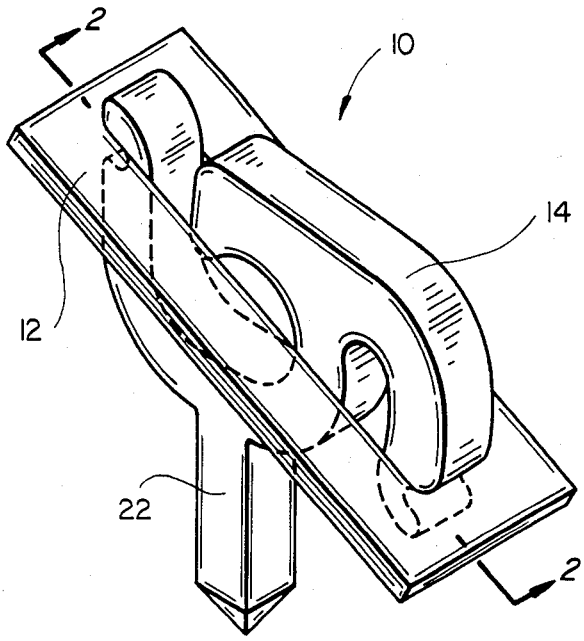
FIG. 1 is a perspective view of the preferred embodiment of the present invention.

With continued reference to the drawing, FIG. 1 discloses a connecting device shown generally at 10 in perspective view. Connecting device 10 comprises a driver 12 of heat-recoverable metallic material, said driver connected to socket 14 by being disposed about socket 14.

Figure 2:
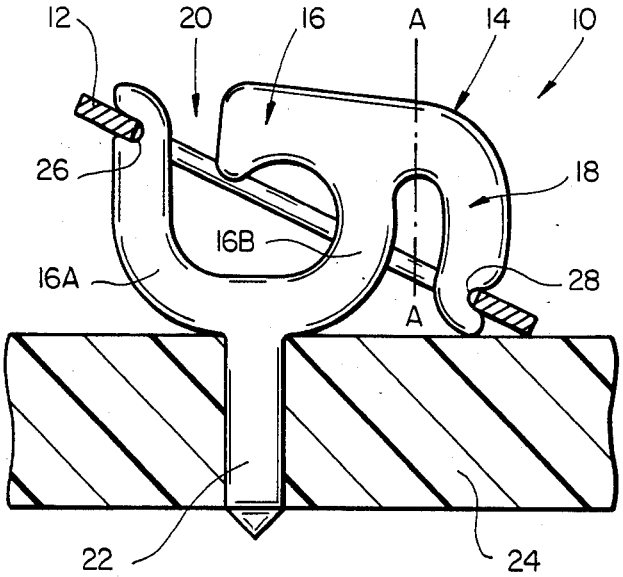
FIG. 2 is a cross-sectional view taken along section lines 2—2 in FIG. 1.

As can be more clearly seen in FIG. 2, socket 14 comprises biasing portion 16 and sequentially-operating overload portion 18. The overload portion 18 is operatively connected to the biasing portion outboard of the biasing portion. Section line A—A is shown to generally distinguish the portions 16 and 18. Socket 14 also includes post portion 22 which is used to secure connecting device 10 with respect to a substrate 24 and to electrically interconnect connecting device 10 with electrical circuitry (not shown).

In this embodiment, biasing portion 16 has two spring-like members or tines 16A and 16B which define a tuning-fork-like structure having an opening, shown generally at 20, therebetween to receive an object such as a pin. The biasing portion 16 (members 16A and 16B) are capable of being moved inwardly and when so moved exert an outward force on the means, i.e. driver 12, which moves portion 16 inwardly. It is within the scope of the invention to have members 16A and 16B of differing stiffness.

Driver 12 is made from heat-recoverable metal such as that disclosed earlier. Driver 12 is preferably stamped from a sheet of such metal. Driver 12 may be deformed or elongated while in its martensitic state, and will revert to its original configuration when heated to a temperature at which it transfers to its austenitic state. Specifically driver 12 will recover to a smaller longitudinal dimension.

It can be seen in FIG. 2 that driver 12 is disposed about socket 14 and is retained in position by detent 26 in member 16A and detent 28 in member 18. Driver 12 is shown in FIG. 2 in its elongated condition. Recovery of driver 12 will move the biasing portion 16 (members 16A and 16B) inwardly and when said elements are so moved, they will exert an outward force on driver 12. The overload portion 18 is stiffer than the biasing portion 16. Overload portion 18 will move inwardly after biasing portion 16 has moved inwardly and will act as an overload mechanism for the driver 12.

Socket 14 is made from a spring-like material as for example beryllium copper. This material has high strength and yet may be soldered, plated, and is itself an excellent electrical conductor. Post portion 22 of socket 14 may be placed through a hole in a substrate 24 such as a circuit board and may be soldered to the board.

Socket 14 has a biasing portion 16 and an overload portion 18 which, when moved inwardly, exhibit a spring-back force sufficient to expand driver 12 when the driver is in its martensitic state. In FIG. 2, portions 16 and 18 can be described as operating on a cantilever beam principle. Biasing portion 16 has members 16A and 16B having a fixed point at the base of their tuning-fork-like structure and overload portion 18 has a fixed point generally about section line A—A. Force is applied to biasing portion 16 at detent 26 by one end of driver 12, bending biasing portion 16 generally about its fixed point forcing biasing portion 16 against an object that may be inserted in the opening 20. Force is applied to the overload portion 18 at detent 28 by band 12. Force applied to overload portion 18 is transferred directly to biasing portion 16, bending biasing portion 16 about its fixed point, forcing second biasing portion 16 against an object inserted through opening 20. If biasing portion 16 is unable to move or bend, such as when opening 20 is completely occupied by a large-diameter pin such as in FIG. 4, then overload portion 18 bends about its fixed point noted by section line A—A and therefore acts as an overload spring. This action may be described as being sequential.

Figure 3:
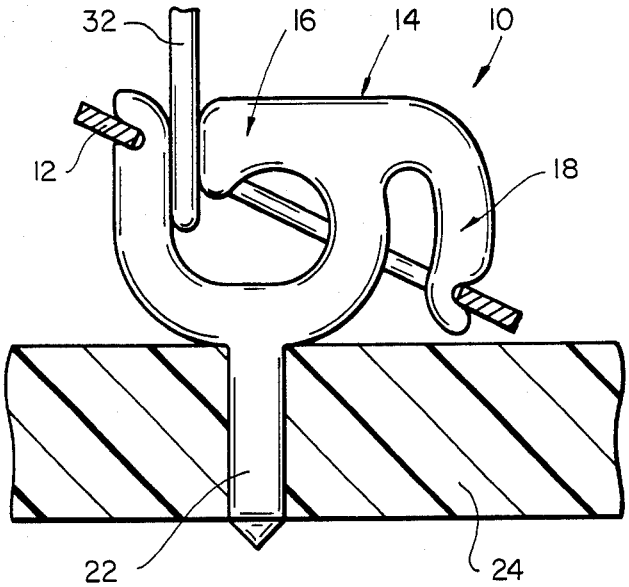
FIG. 3 is a cross-sectional view similar to FIG. 2 wherein an object in the form of a small-diameter pin has been inserted and is being retained by the connecting device.

FIG. 3 shows the connecting device 10 wherein an object in the form of a small-diameter pin 32 has been inserted and is being retained by the connecting device. In this situation, driver 12 has recovered to its smaller dimension in its austenitic state and has moved biasing portion 16 and overload portion 18 inwardly to engage pin 32. Portions 16 and 18 exert an outward force on driver 12. It can be appreciated that overload portion 18 is stronger, i.e. requires more force to bend than biasing portion 16. In FIG. 3, overload portion 18 has generally not moved inwardly or bent with respect to biasing portion 16. It can be appreciated that the device of the instant invention can accommodate a variety of object configurations, e.g., square, rectangular, etc.

Figure 4:
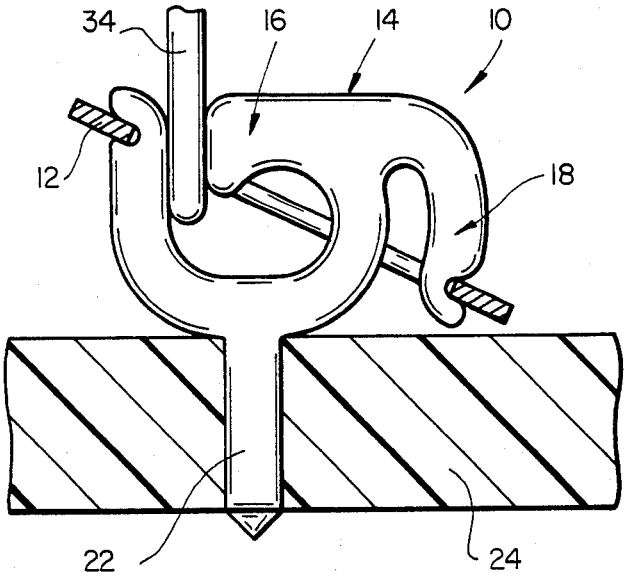
FIG. 4 is a cross-sectional view similar to FIG. 2 wherein a large-diameter pin has been inserted into and is being retained by the resilient member.

In contrast, in FIG. 4, where a large-diameter pin 34 has been inserted into the connecting device 10, the overload portion 18 has moved with respect to biasing portion 16. FIG. 4 shows how the connecting device of the instant invention utilizes the overload portion 18 of the socket 14. When an object in the form of a thick pin 34 is placed within socket 14 and driver 12 is caused to recover and shrink, the biasing portion 16 is forced inwardly to contact and hold pin 34. When biasing portion 16 can move no further, then overload portion 18 acts as an overload spring for the driver 12.

Figure 5:
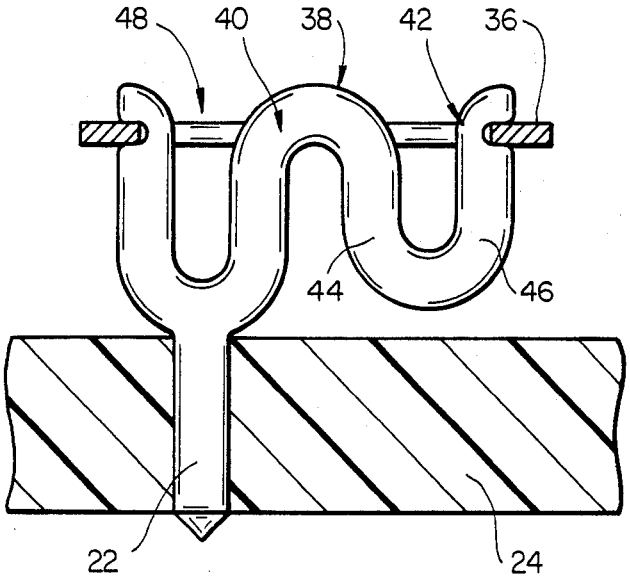
FIG. 5 is a partial cross-sectional view similar to FIG. 2 of an alternate embodiment of the instant invention.

FIG. 5 shows an alternate embodiment of the instant invention wherein a heat-recoverable driver 36 is disposed about a socket 38 having a biasing portion 40 and a U-shaped overload portion 42. In such an embodiment, members 44 and 46 may combine to act as an overload spring when an object or pin is inserted through opening shown generally at 48.

Figure 6:
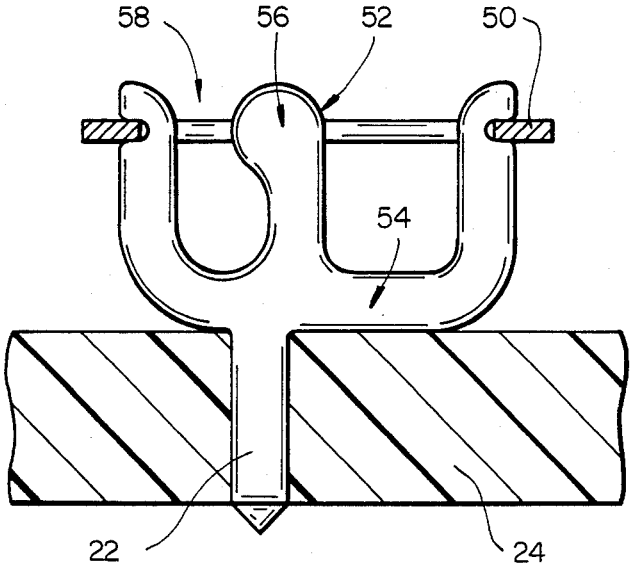
FIG. 6 is a cross-sectional view similar to FIG. 2 of another alternate embodiment of the instant invention.

FIG. 6 shows yet another embodiment of the instant invention wherein a heat-recoverable driver 50 is disposed about a socket shown generally at 52 and having biasing portion 54 and overload portion 56. In this embodiment, the socket biasing portion 54 is operatively connected to the overload portion 56 outboard of the overload portion 56. An object in the form of a pin may be inserted through opening shown generally at 58 and will be retained by overload portion 56 when driver 50 recovers to its smaller dimension. Should the pin completely occupy opening 58, then overload portion 56 will bend and will act as an overload spring and thus operate without direct contact with the driver.

Figure 7:
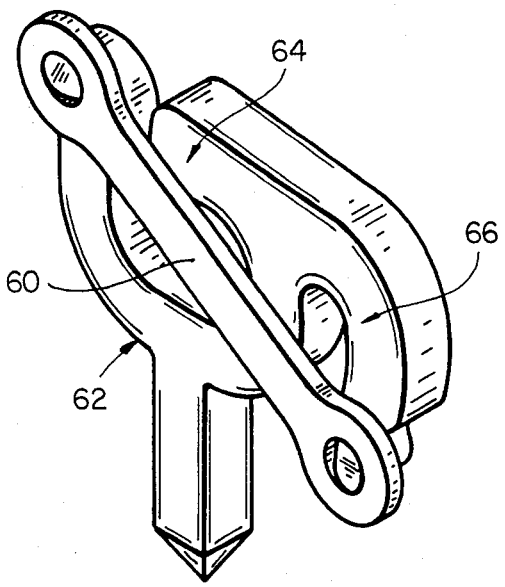
FIG. 7 is a perspective view similar to FIG. 1 of yet another alternate embodiment of the instant invention.

FIG. 7 shows still another embodiment of the instant invention wherein a heat-recoverable driver 60 is connected to a socket 62 having a biasing portion 64 and an overload portion 66. This figure illustrates that the driver need not be disposed about the socket and may be a simple linear element. The driver may have various configurations as appropriate for complementary objects to be inserted within the device. This figure shows that the driver may also be discontinuous and not be disposed about the socket. The driver 60 may also be generally C-shaped.

Figure 8A:
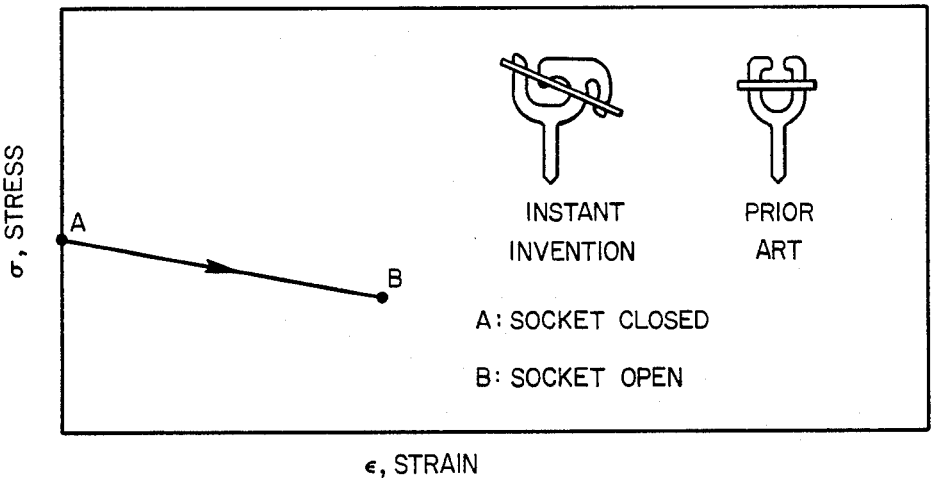
FIGS. 8A, B and C illustrate by the use of stress/-strain diagrams the function of the overload portion of the instant invention.
Figure 8B:
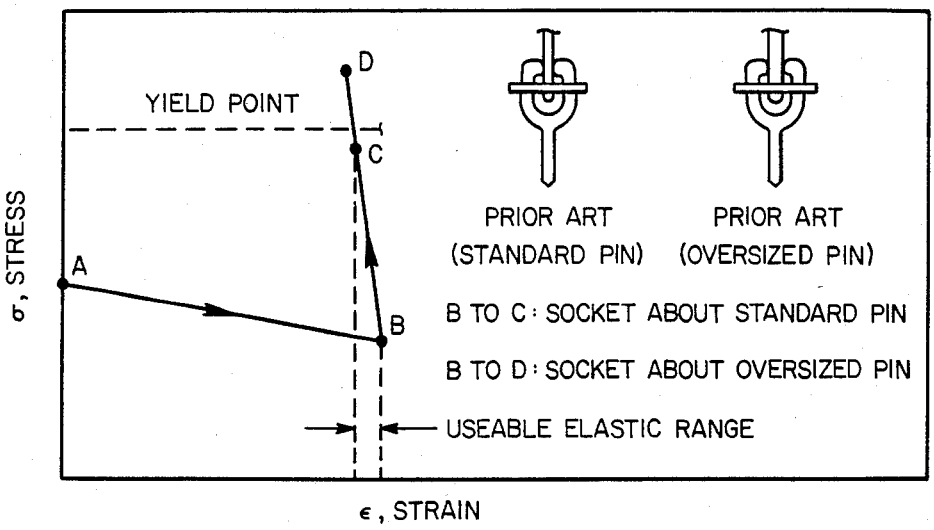
Figure 8C:
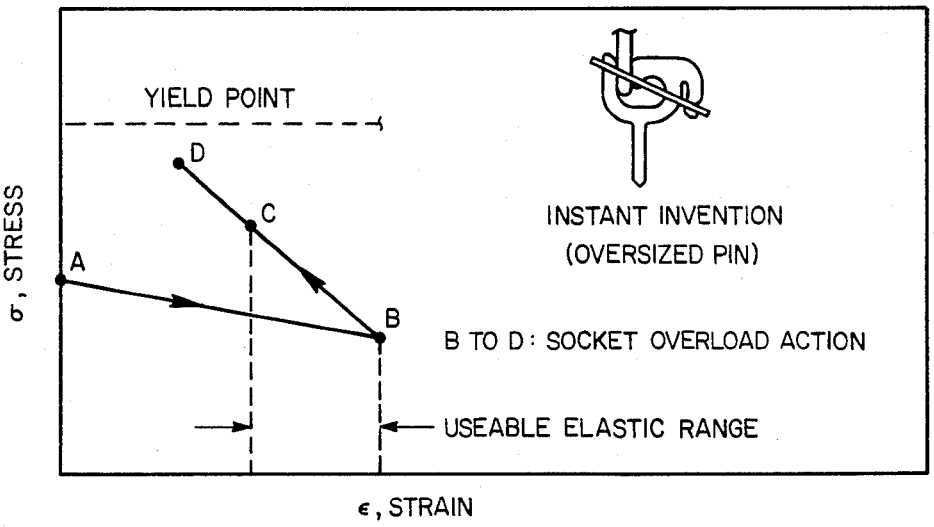

FIG. 8A illustrates the excursion (A-B) of stress experienced by a driver due to the outward force generated by the socket biasing. The opening stress experienced by the driver is the same in the instant invention and in the prior-art device, i.e. that disclosed in U.S. Pat. No. 3,740,839 and the Reissue thereof, when the socket opens. FIG. 8B illustrates the increase in driver stress (B-C) when the driver is caused to shrink and the socket closes on a pin of maximum diameter in accordance with the prior art. If a larger, oversized-diameter pin were used, then the stress experienced by the driver would move to point D on the diagram past the yield point of the driver, thus destroying the utility and reusability of the device. In FIG. 8C, such an oversized-diameter pin has been inserted into the device of the instant invention and the driver has been caused to shrink as in FIG. 8B. It can be seen that due to the elastic deformation of the socket overload portion of the instant invention, the driver stress B-D is maintained below the yield point of the driver.

It can be seen that the usable pin-size range of the prior-art device is limited to the elastic range noted in FIG. 8B, which is inherent in the driver material alone. In contrast, the instant invention simulates an extended elastic range of the driver by utilizing the composite effect of the elastically-deformable overload portion of the socket and the inherent elasticity of the driver as shown in FIG. 8C.

The present embodiments of this invention are thus to be considered in all respects as illustrative and not restrictive, the scope of the invention being indicated by the appended claims rather than by the foregoing description. All changes which come within the meaning and range of equivalency of the claims therefore are intended to be embraced therein.

What is claimed is:

1. A reusable connecting device comprising:

a resilient socket to receive and to provide high contact force with an object to be connected, said socket having a biasing portion and a sequentially operating overload portion, said portions capable of being moved inwardly and when so moved to exert an outward force, the biasing portion including two opposed legs for gripping the object to be connected about its axis and the overload portion comprising a resilient arm extending from one of said legs transversely away from the axis of the object to be gripped; and a heat-recoverable metallic driver connected to the socket, the metal of said driver having a martensitic state and an austenitic state, said driver capable of being expanded dimensionally by an outward force exerted by the biasing and overload portions of the socket when said driver is in its martensitic state, a change from its martensitic state to its austenitic state recovering said driver to its non-expanded dimension, initially moving the biasing portion inwardly until it contacts an object to be inserted within the socket, providing a high contact force with such an object, the overload portion subsequently moving inwardly after the biasing portion is unable to move, further providing a large range of dimensional compliance and acting as an overload mechanism when movement of the biasing portion is limited.

2. A device as in claim 1 wherein the socket overload portion is operatively connected to the biasing portion outboard of the biasing portion.

3. A device as in claim 2 wherein the socket biasing portion is a tuning-fork-like structure.

4. A device as in claim 3 wherein the tuning-fork-like structure has two tines of differing stiffness.

5. A device as in claim 2 wherein the socket overload portion is U-shaped.

6. A device as in claim 1 wherein the driver is disposed about and in contact with the socket.

7. A device as in claim 1 wherein the driver is a linear element.

8. A device as in claim 1 wherein the driver is discontinuous and not disposed about the socket.

9. A reusable connecting device comprising:

a socket to receive and to provide high contact force with an object to be gripped about its axis at a position within the socket, said socket having a biasing portion and an overload portion, said portions capable of being moved inwardly and when so moved to exert an outward force, said biasing portion being operatively connected to the overload portion outboard of the overload portion with respect to the axis of the object when gripped; and a heat-recoverable metallic driver connected to the socket, the metal of said driver having a martensitic state and an austenitic state, said driver capable of being expanded dimensionally by an outward force exerted by the portions of the socket when said driver is in its martensitic state, a change from its martensitic state to its austenitic state recovering said driver to its non-expanded dimension to move both portions inwardly until the overload portion contacts said object to be inserted within the socket to provide a high contact force with such an object, the biasing portion, at the urging of the driver as it continues to recover, capable of continued inward movement toward the overload portion, the relative movement of the portions with respect to each other providing a large range of dimensional compliance and acting as an overload mechanism.

* * * * *